United States Patent [19]

Ellis

[11] 4,245,754

[45] Jan. 20, 1981

[54] CONTAINER INCLUDING PLASTIC MOLDED RECEPTACLE AND COVER WITH BUTTRESS RETAINERS

[76] Inventor: Henry D. Ellis, 1003 Whetstone Way, Louisville, Ky. 40223

[21] Appl. No.: 81,961

[22] Filed: Oct. 4, 1979

[51] Int. Cl.[3] ..... B65P 53/00

[52] U.S. Cl. ..... 220/304; 220/296; 220/306; 220/308; 150/0.5; 215/318

[58] Field of Search ..... 220/288, 296, 304, 306, 220/308; 150/0.5; 215/318

[56] References Cited

U.S. PATENT DOCUMENTS

| | | | |
|---|---|---|---|
| 3,804,289 | 4/1974 | Churan | 150/0.5 X |
| 3,998,355 | 12/1976 | Galer | 220/288 X |
| 4,126,246 | 11/1978 | Galer | 220/304 |

*Primary Examiner*—George T. Hall

*Attorney, Agent, or Firm*—Reising, Ethington, Barnard, Perry & Brooks

[57] ABSTRACT

A container (10) disclosed includes a unitary receptacle (12) and a unitary cover (14) which are each molded from resilient plastic with segmented buttress retainers (24, 32) that cooperate to secure the cover upon a snap action closing movement while permitting opening cover movement by manual rotation. The container has particular utility as a paint pail for holding paint, stain, or the like but is also useful for holding food or other contents. An upper open end on a side wall (16) of the receptacle has a round surface (22) on which circumferentially spaced sets of the buttress retainers (24) are located with horizontal retaining flanks thereof facing downwardly and inclined flanks thereof extending downwardly and radially to the associated retaining flanks. An annular lip (28) of the cover extends downwardly from an upper wall (26) thereof and has a round surface (30) on which circumferentially spaced sets of buttress retainers (32) are located with horizontal retaining flanks thereof facing upwardly and inclined flanks thereof extending radially and upwardly to the associated retaining flanks. Downward cover movement slidably engages the inclined flanks on the retainers of the cover with the inclined flanks on the retainers of the receptacle to provide the snap action that engages the retaining flanks to secure the cover while permitting subsequent opening movement by cover rotation. A groove (42) in the cover adjacent the juncture of its upper wall (26) and lip (28) receives a seal (44) that is engaged by the upper end of the receptacle to seal the container when the cover is secured. A reinforcing rib (46) and handle lug (48) construction on the upper end of the receptacle side wall is also provided as is a receptacle rib (58) and cover recess (59) stacking construction.

11 Claims, 5 Drawing Figures

CONTAINER INCLUDING PLASTIC MOLDED RECEPTACLE AND COVER WITH BUTTRESS RETAINERS

TECHNICAL FIELD

This invention relates generally to a container that has particular utility for use as a paint pail for holding paint, stain or the like and as such will be described in connection with this usage with the understanding that the container has other usages such as for storing food or other contents.

BACKGROUND ART

Paint, stain and the like are conventionally sold at the retail level in metal pails of a one gallon size having an upper edge with a groove in which an annular edge of a metal cover is secured by a press fit. Opening of the cover is performed by prying the cover edge upwardly in order to open the pail so that the stored paint or stain can be used. Such metal pails are conventionally made from tin plated steel which has become more and more expensive in the recent past. Also, the ever-increasing use of water-based latex paint with steel paint pails has necessitated the use of a special coating on the interior of the pail in order to prevent the water from causing corrosion as the paint is stored. Another problem with metal paint pails is that such pails tend to dent when struck or dropped.

One prior attempt at making a paint pail from other than metal utilized injection/blow molding of polypropylene plastic in order to overcome the corrosion problem when water-based latex paints are stored. This pail required a molded bead on the inner surface at the upper end of the pail in order to secure an associated cover with the required strength that is necessary to pass drop tests that paint pails are subjected to before being accepted commercially by paint manufacturers.

In securing the cover in position, it is also important that the cover be easily removable when desired so that the paint can be used. One might think that helical threads on a plastic paint pail would advantageously permit secure closing of the cover as well as easy opening. However, such a plastic pail and cover construction would not be commercially acceptable as paint manufacturers have extensive capital investments in dispensing machinery that is only capable of closing the cover by a unidirectional movement such as is used with the conventional metal pail and cover fit that is pried open.

U.S. Pat. Nos. relating to containers, retainers and the like include: 680,386; 1,596,367; 1,672,839; 2,069,125; 2,148,468; 2,205,685; 2,257,715; 2,304,912; 2,467,392; 2,487,400; 2,542,350; 2,556,765; 2,971,671; 3,288,342; 3,329,302; 3,355,060; 3,380,610; 3,433,385; 3,804,288; 3,814,277; 3,815,777; 3,868,041; 3,878,963; 3,931,891; and 4,053,078.

DISCLOSURE OF INVENTION

An object of the present invention is to provide an improved container including a unitary receptacle and a unitary cover which are each molded from resilient plastic with a construction that permits the cover to be securely fixed to the receptacle by a snap action closing as well as readily released by a rotational opening movement.

The improved container disclosed has particular utility as a paint pail capable of holding paint, stain or the like so as to overcome the cost, corrosion, denting, and cover securement problems that are present with conventional metal paint pails.

In carrying out the above object and other objects of the invention, the improved container is embodied by a paint pail having a plastic receptacle and a plastic cover with segmented buttress retainers for providing the snap action cover closing that securely fixes the cover on the receptacle while permitting relatively easy opening by cover rotation. The buttress retainers on the receptacle project radially in a circumferentially spaced relationship on the upper end of a cylindrical side wall thereof whose lower end is closed by a bottom wall of the receptacle to define an upwardly opening shape. Each buttress retainer on the receptacle side wall has a curved shape and includes a generally horizontal retaining flank that faces downwardly and an inclined flank that extends downwardly and radially with respect to the receptacle to the associated retaining flank. The buttress retainers on the cover are spaced circumferentially from each other and project radially from an annular lip which extends downwardly from an upper wall of the cover. Each buttress retainer on the cover lip has a curved shape and includes a horizontal retaining flank that faces upwardly and an inclined flank that extends upwardly and radially with respect to the cover lip to the associated retaining flank.

Upon closing, the cover of the paint pail is moved downwardly over the receptacle thereof such that the inclined flanks on the buttress retainers of the cover slidably engage the inclined flanks on the buttress retainers of the receptacle so as to ultimately provide a snap action that engages the retaining flanks on the buttress retainers of the cover with the retaining flanks on the buttress retainers of the receptacle in order to secure the cover. The buttress retainers on the cover lip have curved lengths that are shorter than the circumferential spacing between the buttress retainers on the receptacle side wall such that cover rotation disengages the buttress retainers on the cover from the buttress retainers on the receptacle and thereby permits the cover to be moved upwardly for opening.

In the preferred construction disclosed, the buttress retainers on the receptacle are located on a round outer surface of the side wall such that the inclined flanks of these retainers extend downwardly and outwardly to their associated retaining flanks. The buttress retainers on the cover are located on a round inner surface of the downwardly extending lip thereof such that the inclined flanks of these retainers extend upwardly and inwardly to their associated retaining flanks.

The plastic cover of the paint pail includes an annular groove adjacent the juncture of its upper wall and downwardly extending lip. An annular seal is received within the groove of the cover so as to be compressed against the upper end of the receptacle side wall with the cover secured such that the pail is closed in a sealed condition. A neoprene or an aerobic material are suitable for providing the annular seal.

Both the receptacle and the cover of the paint pail preferably include circumferentially spaced sets of the buttress retainers so that more than one pair of retainers engage each other at each circumferential location to secure the cover in position. In one embodiment, the buttress retainers on both the receptacle and the cover extend circumferentially without any pitch in order to maintain seal compression upon cover rotation so as to be resistant to rotation and consequent opening. Another embodiment has the buttress retainers on both the receptacle and the cover extending circumferentially with a pitch in order to provide an unthreading action that releases the seal compression and thereby facilitates cover rotation upon opening.

The outer surface at the upper end on the receptacle side wall of the paint pail includes at least one reinforcing rib and preferably includes a plurality of such reinforcing ribs. Diametrically opposed handle lugs also project outwardly from the upper end on the receptacle side wall and are connected to the reinforcing ribs which provide support thereto as well as resiliently permitting flexing upon the snap action closing of the cover. With the cover closed, the ribs provide the required resistance to flexing in order to maintain the engagement of the retaining flanks on the buttress retainers so as to secure the cover in position.

Polypropylene plastic is preferably utilized to injection mold both the cover and the receptacle with unitary constructions. This plastic material is manufactured from natural gas and its availability is thus not dependent on the supply of crude oil from which other plastics are manufactured. Also, polypropylene plastic has good impact characteristics which is important when utilizing the container as a paint pail so as to be capable of passing the drop tests paint manufacturers normally use. Other resilient plastics can also be utilized, even though polypropylene is preferred, provided the plastic has a secant flexural modulus between about 105,000 and 350,000 pounds per square inch so as to have the requisite flexibility to permit the snap action cover closing as well as the requisite strength to maintain the buttress retainers in engagement with each other so that the cover is retained in its closed condition.

The objects, features, and advantages of the improved container of the present invention will be readily apparent from the following detailed description of the best modes for carrying out the invention when taken in connection with the accompanying drawings.

BEST MODES FOR CARRYING OUT THE INVENTION

Figure 1:
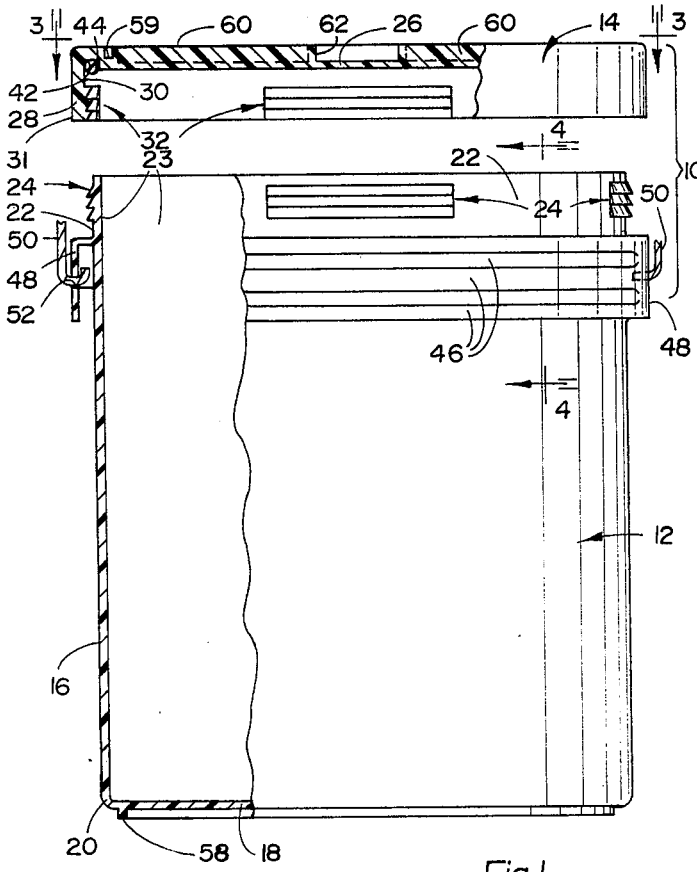
FIG. 1 is a partially broken away side elevation view of a paint pail that is constructed in accordance with the present invention and shown with a cover thereof in an open position with respect to a receptacle of the pail.

Referring to FIG. 1 of the drawings, a paint pail for holding paint, stain or the like is constructed in accordance with the present invention and generally indicated by reference numeral 10. Pail 10 may be of any desired size and includes a unitary receptacle 12 and a unitary cover 14 which are each molded from resilient plastic.

Pail receptacle 12 illustrated in FIG. 1 includes a generally cylindrical side wall 16 and a bottom wall 18. Side wall 16 has a lower end that is closed by the bottom wall 18 and connected thereto by a rounded junction 20 of an annular shape. Side wall 16 also includes an upper end that defines an open upper end of the receptacle and has round outer and inner surfaces 22 and 23. A plurality of segmented buttress retainers 24 project radially on the outer surface 22 in an outward direction and are arranged in circumferentially spaced sets for use in securing the container cover 14 as is hereinafter described.

Cover 14 of the pail includes an upper wall 26 and an annular lip 28 that extends downwardly from the upper wall and has round inner and outer surfaces 30 and 31. Cover lip 28 has a larger size than the receptacle side wall 16 so as to be capable of receiving the upper end thereof upon downward movement of the cover over the receptacle. Inner surface 30 of the cover lip 28 includes segmented buttress retainers 32 projecting radially in an inward direction and arranged in sets spaced circumferentially with respect to each other so as to cooperate with buttress retainers 24 on the receptacle in securing the cover in closed position.

Figure 2:
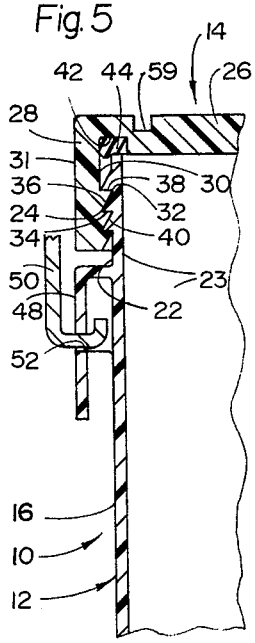
FIG. 2 is an elevational view in section through the paint pail illustrating the cover thereof secured in a closed position on the receptacle.

With further reference to FIG. 2, each buttress retainer 24 on the receptacle side wall 16 includes a generally horizontal retaining flank 34 that faces downwardly and an inclined flank 36 that extends downwardly and radially in an outward direction with respect to the receptacle to the associated retaining flank. Each buttress retainer 32 on the cover lip 28 includes a generally horizontal retaining flank 38 that faces upwardly and an inclined flank 40 that extends upwardly and radially in an inward direction with respect to the cover lip to the associated retaining flank.

Upon downward movement of the cover 14 from the position shown in FIG. 1 toward the position shown in FIG. 2, the cover lip 28 receives the upper open end of the receptacle side wall 16 and the inclined flanks 40 on the buttress retainers 32 of the cover slidably engage the inclined flanks 36 of the buttress retainers 24 on the receptacle so as to ultimately provide a snap action that engages the retaining flanks 38 of the buttress retainers on the cover with the retaining flanks 34 of the buttress retainers on the receptacle in order to secure the cover in position. Buttress retainers 34 on the cover lip 28 have curved lengths that are shorter than the circumferential spacing between the buttress retainers 24 on the receptacle such that the secured cover can be rotated to disengage the buttress retainers thereof from the buttress retainers of the receptacle and thereby permit opening movement of the cover in an upward direction.

As seen in FIGS. 1 and 2, the cover 14 includes an annular groove 42 adjacent which the cover lip 28 has a juncture with the upper wall 26. An annular seal 44 is received within the annular groove 42 so as to be compressed against the upper end of the receptacle side wall 16 with the cover secured in closed position in order to thereby provide a sealed condition of the pail. Seal 44 may be made from a neoprene material or from an aerobic seal material as well as any other suitable material capable of providing the seal condition with the cover closed.

During closing, the cover 14 can be easily tapped to progressively engage one, then two, etc. pairs of the retainers 24 and 32 until all of the retainers are engaged and the seal 44 fully compressed with the cover secured. Thus, closing of the cover is achieved without requiring any great manual force. Both the upper end of the receptacle side wall 16 which flexes inwardly and the cover lip 28 which flexes outwardly as the closing takes place must be resilient to allow the flexing but must also have sufficient strength to maintain the buttress retainers 24 and 32 in engagement after closing is completed.

It will be noted in FIG. 1 that the buttress retainers 24 on the receptacle as well as the buttress retainers 32 on the cover do not have any vertical pitch. As such, rotation of the cover 14 for opening movement does not release any of the compressive forces on the seal 44 and the cover is thus retained thereby against rotational movement so as to be held more securely closed.

Figure 5:
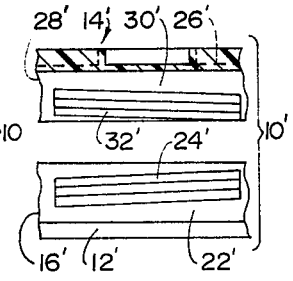
FIG. 5 is a partial view illustrating another embodiment of the paint pail which includes buttress retainers having a pitch.

In an alternate embodiment illustrated in FIG. 5, the paint pail 10' includes a receptacle 12' and a cover 14' whose associated buttress retainers 24' and 32' have a vertical pitch that provides an unthreading action which moves the cover upwardly as it is rotated to provide opening. Such upward movement provided by the unthreading action of the pitched buttress retainers lessens the interface force between the associated seal and the upper end of the receptacle side wall 16' so as to thereby facilitate the cover rotation as the opening proceeds.

Figure 4:
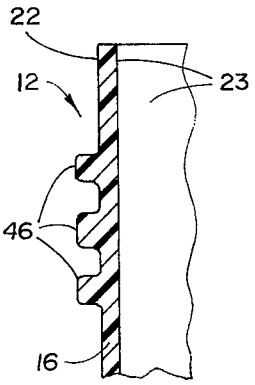
FIG. 4 is an elevation view taken in section along line 4—4 of FIG. 1 illustrating reinforcing ribs of the receptacle.

As seen by combined reference to FIGS. 1, 2, and 4, the outer surface 22 on the upper end of the receptacle side wall 16 includes a plurality of annular reinforcing ribs 46 located below the buttress retainers 24 and projecting in an outward direction from the receptacle. A pair of diametrically opposed handle lugs 48 also project outwardly from the upper end of the receptacle side wall 16 and are connected to the reinforcing ribs so as to be supported thereby. Bent ends 50 of a handle are received within holes 52 in the handle lugs 48 so that the pail can be carried. Of course, it is also possible to have other handle end and lug constructions. Ribs 46 not only provide support for the handle lugs 48 but also rigidify the receptacle side wall 16 adjacent the buttress retainers 24 so as to provide strength that prevents inward deflection with the cover closed in order to maintain the cover in its sealed condition on the upper end of the receptacle. Ribs 46 also provide strength to the receptacle for carrying by the handle with the cover removed in order to prevent deflection of the receptacle that could cause its liquid contents to spill.

Both the receptacle 12 and the cover 14 are preferably injection molded from polypropylene plastic which has a flexural modulus that permits the flexing required during closing of the cover but which has the required strength to maintain the cover in closed position. While polypropylene plastic is the preferred material for injuction molding the receptacle and the cover, other plastics can also be used so long as the material has a secant flexural modulus between about 105,000 and 350,000 pounds per square inch so as to have the required resiliency to permit snap action closing of the cover as well as the required strength to maintain the cover in closed position. Use of plastics is also preferable because of their lubricity in order to facilitate the snap action cover closing as the inclined flanks 36 and 40 of the buttress retainers slide against each other.

Figure 3:
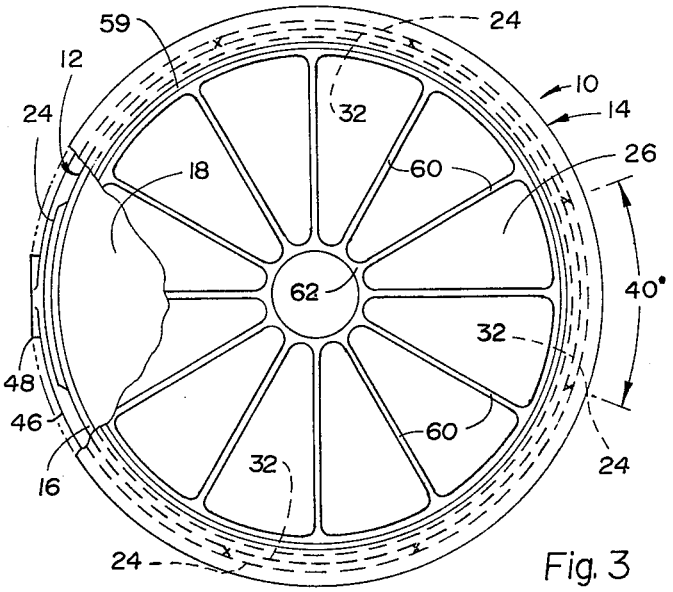
FIG. 3 is a top plan view of the paint pail taken along line 3—3 of FIG. 1 and partially broken away for illustrative purposes.

As seen in FIG. 3, there are four sets of buttress retainers 24 and 32 on the receptacle and the cover in an equally spaced circumferential relationship. Each buttress retainer 24 and 32 extends for a curved length of about 40° so that there is a spacing of approximately 50° between the retainers on both the receptacle and the cover. This greater spacing between the retainers than their arcuate lengths allows the opening cover movement in the manner previously described once the cover has been rotated from its closed position.

As seen in FIG. 1, the bottom wall 18 of the pail receptacle 12 includes an annular rib 58 and the upper wall 26 of cover 14 includes an annular recess 59 such that a plurality of the pails can be stacked with the annular recess of each cover receiving the annular rib on the bottom wall of the next higher pail. Cover 14 also includes ribs 60 arranged in a spoke-like manner projecting radially from an annular rib 62 as shown in FIG. 3 so as to allow the cover to be manually grasped for rotation that releases the cover as previously described.

Also, receptacle side wall 16 preferably has a slight draft, i.e. about 2°, so as to taper from a greater thickness at its lower end to a lesser thickness at its upper end in order to facilitate the plastic injection molding. Annular lip 28 of the cover likewise has a draft so as to taper from its upper end which has a greater thickness to its lower end which has a lesser thickness, a draft of about ½° being sufficient since the cover lip has a much shorter height than the receptacle side wall.

Closing of the cover 14 by conventional automatic paint dispensing equipment will always be performed by downward cover movement that effects the snap action securement previously described. After an initial opening, the cover can likewise be tapped closed with a hammer to effect the snap action closing. Reclosing can also be performed by moving the cover downwardly with the cover retainers 32 between the receptacle retainers 24 and then rotating the cover to engage the retainers without any snap action.

While preferred embodiments illustrating the best modes for carrying out the invention have herein been described in detail, those familiar with the art to which this invention relates will recognize various alternative designs and embodiments for practicing the present invention as defined by the following claims.

What is claimed is:

1. A container comprising: a unitary receptacle and a unitary cover each of which is molded from resilient plastic; said receptacle including a generally cylindrical side wall and a bottom wall; the side wall including an upper end that defines an open end of the receptacle; the side wall also including a lower end that is closed by the bottom wall to define a closed end of the receptacle; the upper end of the side wall having round inner and outer surfaces one of which includes a plurality of circumferentially spaced buttress retainers of curved shapes; each buttress retainer on the upper end of the side wall including a generally horizontal retaining flank that faces downwardly and an inclined flank that extends downwardly and radially to the associated retaining flank; said cover including an upper wall and an annular lip that extends downwardly from the upper wall; said annular lip of the cover having round inner and outer surfaces one of which includes circumferentially spaced buttress retainers; each buttress retainer on the cover lip including a generally horizontal retaining flank that faces upwardly and an inclined flank that extends upwardly and radially to the associated retaining flank; the cover being movable downwardly over the receptacle such that the inclined flanks of the buttress retainers on the cover lip slidably engage the inclined flanks of the buttress retainers on the receptacle so as to ultimately provide a snap action that engages the retaining flanks on the buttress retainers of the cover with the retaining flanks on the buttress retainers of the receptacle in order to secure the cover on the receptacle; and the buttress retainers on the cover lip having curved lengths that are shorter than the circumferential spacing between the buttress retainers on the receptacle side wall such that the secured cover can be rotated to disengage the buttress retainers thereof from the buttress retainers of the receptacle and thereby permit upward opening movement of the cover.

2. A container comprising: a unitary receptacle and a unitary cover each of which is molded from resilient plastic; said receptacle including a generally cylindrical side wall and a bottom wall; the side wall including an upper end that defines an open end of the receptacle; the side wall also including a lower end that is closed by the bottom wall to define a closed end of the receptacle; the upper end of the side wall having a round outer surface including a plurality of circumferentially spaced buttress retainers of curved shapes; each buttress retainer on the upper end of the side wall including a generally horizontal retaining flank that faces downwardly and an inclined flank that extends downwardly and outwardly with respect to the receptacle to the associated retaining flank; said cover including an upper wall and an annular lip that extends downwardly from the upper wall and has a larger size than the receptacle side wall so as to be capable of receiving the upper end thereof upon downward movement of the cover over the receptacle; the annular lip of the cover having a round inner surface including circumferentially spaced buttress retainers; each buttress retainer on the cover lip including a generally horizontal retaining flank that faces upwardly and an inclined flank that extends upwardly and inwardly with respect to the cover lip to the associated retaining flank; the cover being movable downwardly over the receptacle such that the cover lip receives the open end of the receptacle and slidably engages the inclined flanks on the buttress retainers of the cover with the inclined flanks on the buttress retainers of the receptacle so as to provide a snap action that ultimately engages the retaining flanks on the buttress retainers of the cover with the retaining flanks on the buttress retainers of the receptacle in order to secure the cover on the receptacle; and the buttress retainers on the cover lip having curved lengths that are shorter than the circumferential spacing between the buttress retainers on the receptacle side wall such that the secured cover can be rotated to disengage the buttress retainers thereof from the buttress retainers of the receptacle and thereby permit upward opening movement of the cover.

3. A container as in claims 1 or 2 wherein the cover includes an annular groove adjacent which the lip is connected to the upper wall, and an annular seal that is received within the groove of the cover and compressed by the upper end of the receptacle side wall with the cover secured thereto in order to provide a sealed condition.

4. A container as in claim 3 wherein the buttress retainers on both the receptacle and the cover extend circumferentially without any pitch so as to maintain compression of the seal as the cover is rotated and thereby securely retain the cover on the receptacle.

5. A container as in claim 3 wherein the buttress retainers on both the receptacle and the cover extend circumferentially with a pitch in order to provide an unthreading action as the cover is rotated upon opening so as to release the compression on the seal and thereby facilitate the opening rotation.

6. A container as in claims 1 or 2 wherein both the receptacle and the cover include circumferentially spaced sets of the buttress retainers.

7. A container as in claims 1 or 2 wherein the outer surface on the upper end of the receptacle side wall includes at least one reinforcing rib, and a pair of diametrically opposed handle lugs that project outwardly from the upper end of the receptacle side wall and which are connected to the reinforcing rib.

8. A container as in claims 1 or 2 wherein the receptacle and cover are each injection molded from polypropylene.

9. A container as in claims 1 or 2 wherein the upper wall of the cover includes ribs that are manually grasped to rotate the cover.

10. A paint pail for paint, stain or the like comprising: a unitary receptacle and a unitary cover each of which is injection molded from resilient plastic; said receptacle including a generally cylindrical side wall and a bottom wall; the side wall including an upper end that defines an open end of the receptacle; the side wall also including a lower end that is closed by the bottom wall to define a closed end of the receptacle; the upper end of the side wall having a round outer surface including a plurality of circumferentially spaced sets of buttress retainers having curved shapes; each buttress retainer on the upper end of the side wall including a generally horizontal retaining flank that faces downwardly and an inclined flank that extends downwardly and outwardly with respect to the receptacle to the associated retaining flank; said cover including an upper wall and an annular lip that extends downwardly from the upper wall and has a larger size than the receptacle side wall so as to be capable of receiving the upper end thereof upon downward movement of the cover over the receptacle; the cover having an annular groove adjacent which the lip thereof is connected to the upper wall; an annular seal received within the groove of the cover so as to be engageable with the upper end of the receptacle side wall upon downward movement of the cover over the receptacle; the annular lip of the cover having an inner surface including circumferentially spaced sets of ubttress retainers with curved shapes; each buttress retainer on the cover lip including a generally horizontal retaining flank that faces upwardly and an inclined flank that extends upwardly and inwardly with respect to the cover lip to the associated retaining flank; the cover being movable downwardly over the receptacle such that the cover lip receives the open end of the receptacle and slidably engages the inclined flanks on the buttress retainers of the cover with the inclined flanks on the buttress retainers of the receptacle so as to provide a snap action that engages the retaining flanks on the buttress retainers of the cover with the retaining flanks on the buttress retainers of the receptacle in order to secure the cover on the receptacle with the annular seal compressed therebetween; and the buttress retainers on the cover lip having curved lengths that are shorter than the circumferential spacing between the buttress retainers on the receptacle side wall such that the secured cover can be rotated to disengage the buttress retainers on the cover from the buttress retainers of the receptacle and thereby permit upward opening movement of the cover.

11. A pail as in claim 10 wherein the outer surface on the upper end of the receptacle side wall includes a plurality of annular reinforcing ribs and a pair of diametrically opposite handle lugs that project outwardly and are connected to the ribs so as to be supported thereby, the bottom wall of the pail receptacle including an annular rib, the upper wall of the pail cover including an annular recess such that a plurality of the pails can be stacked with the annular recess of each cover receiving the annular rib on the bottom wall of the next higher pail, and the cover also including spoke-like ribs for manually rotating the cover in order to provide disengagement of the buttress retainers.

* * * * *